US006852360B2

(12) United States Patent
Porter et al.

(10) Patent No.: US 6,852,360 B2
(45) Date of Patent: Feb. 8, 2005

(54) KNITTED FABRIC FOR INSECT SCREENING

(75) Inventors: John Frederick Porter, Ontario (CA); Roger Peter Lewington, Ontario (CA)

(73) Assignee: Saint-Gobain Technical Fabrics Canada, Ltd., Midland (CA)

( * ) Notice: Subject to any disclaimer, the term of this patent is extended or adjusted under 35 U.S.C. 154(b) by 0 days.

(21) Appl. No.: 10/786,682

(22) Filed: Feb. 25, 2004

(65) Prior Publication Data

US 2004/0166750 A1 Aug. 26, 2004

Related U.S. Application Data

(62) Division of application No. 10/026,225, filed on Dec. 19, 2001, now Pat. No. 6,716,774.

(60) Provisional application No. 60/256,841, filed on Dec. 20, 2000.

(51) Int. Cl.[7] ..... B05D 1/00

(52) U.S. Cl. ..... 427/209; 427/337; 427/342

(58) Field of Search ..... 427/209, 337, 427/342

(56) References Cited

U.S. PATENT DOCUMENTS

| | | | | | |
|---|---|---|---|---|---|
| 3,214,289 | A | * | 10/1965 | Lefebvre | 442/38 |
| 4,587,997 | A | * | 5/1986 | Brooks | 139/420 R |
| 2003/0026824 | A1 | * | 2/2003 | Platts | 424/411 |

* cited by examiner

*Primary Examiner*—Arti R. Singh
(74) *Attorney, Agent, or Firm*—Duane Morris LLP

(57) ABSTRACT

A knitted screen cloth fabric including a polymer coated, fiber-reinforced, flexible, foil-like web and method for making same are disclosed, the web including a lattice material of filaments and a polyester binding thread.

4 Claims, No Drawings

KNITTED FABRIC FOR INSECT SCREENING

This is a divisional application of U.S. patent application Ser. No. 10/026,225, filed Dec. 19, 2001, now issued as U.S. Pa. No. 6,716,774 which claim the benefit of U.S. Patent Application No. 60/256,841 file Dec. 20, 2000.

BACKGROUND OF THE INVENTION

Field of the Invention

Sheets and tapes consisting of synthetic material are known which are reinforced with longitudinally extending filaments or threads. Such sheets or tapes are intended for packing and binding purposes. The sheets and tapes can in certain cases be provided on one side with an adhesive composition. Basic details concerning such materials are found in U.S. Pat. Nos. 3,214,289 and 4,587,997, herein incorporated by reference.

This invention relates to a flexible, foil-like web which is reinforced with filaments or threads and which is especially suitable for packing purposes, and to the production of tapes for binding purposes or the manufacture of adhesive tapes, especially self-adhesive tapes, the webs or tapes being characterized by high strength values, for example with respect to tensile forces, bending, impact and the like.

The flexible, foil-like web reinforced with filaments in accordance with the invention comprises a large-mesh lattice material consisting of vegetable, animal, mineral, artificial or synthetic filaments, in which the openings in the lattice are each closed by a thin skin of a polymeric substance.

The warp threads, consisting of vegetable, animal, mineral, artificial or synthetic filaments, may be arranged at a regular spacing from one another and united by weft filaments consisting of any suitable textile threads, arranged at such a spacing from one another that an open arrangement or structure is obtained. Such a lattice material may be impregnated with a bath containing dispersions consisting, for example, of rubber (e.g., synthetic) elastomers or polymers, e.g., acrylic based polymers or polyvinyl chloride (homopolymers or copolymers). Thermoplastic materials may likewise be used, preferably together with plasticisers and in paste or dispersed form (plastisols or organosols). Fibers in flake or powder form may also be added to any of these types of impregnants. The impregnation is carried out so that after drying and polymerization, a web is obtained in which the pores or interstices of the lattice material are not closed by a thin film.

DETAILED DESCRIPTION OF THE INVENTION

The present invention relates to a knitted fabric for screening utilizing fiberglass and/or polyester yarns dip-coated with a synthetic material, e.g., polyvinyl chloride (PVC). Note that conventional insect screening is manufactured by: (1) coating individual fiberglass yarns; (2) weaving the yarns into a woven fabric; (3) heat setting the woven fabric so the point of contact of the length direction and cross direction yarns are fused together. This multi-step manufacturing process is complex, expensive and necessitates precise types of yarns for the process. In contrast, the present invention allows for the use of different types of fiber, and provides for a single step heating process that is faster than prevailing methods. Furthermore, being a "single-pass" process (which involves forming, coating and heating), a more precise fabric may be formed (i.e., the fabric will be less "off square"). The drying and/or fusing of the polymer coating will also result in reduced emissions, with a more economical insect screen cloth as a result.

Thus, the present invention relates to a knitted insect screen cloth utilizing a fiberglass or polyester warp yarn and weft yarn with a polyester binding thread. A polymer coating is applied by a dip-coating or screen printing process following the knitting process, or in-line with the knitting process. The polymer is dried and/or fused by passing the fabric over a hot drum or other suitable means. Note that knits have not been previously used for the end use contemplated by the present invention.

The use of "post-coating" fabric offers unexpected advantages over single-end-coating individual strands, followed by weaving and heat-setting, to attain a bond at the intersection of the woven, coated strands. The bond strengths attained with similar coating formulas are listed in Table 1, below:

TABLE 1

| | Slip Resistance (lbs) | |
|---|---|---|
| | Knit-then-coated (invention) | Coated-then-woven (prior art) |
| Warp direction | 20 | 13 |
| Weft direction | 24 | 16 |

The weight of the coating, expressed as a percentage of the weight of the total, coated fabric, may be from about 15–80 weight %, preferably from about 50–70 weight %, and most preferably about 55–65 weight %. In both materials from Table 1, the weight percent of the coating was about 60–65%.

Note that a persistent problem in coating dense fabrics (i.e., with yarn frequencies greater than about 10×10 (warp× weft) ends per inch) is an appearance defect known as "window-paning." Window-paning may be described as dried coating, spanning some of the closed, rectangular areas of the fabric defined by a adjacent pairs of warp and weft yarns. Through the use of a small quantity (e.g., 0.1–0.5% of the coating weight) of a suitable defoamer, such as DC1500, available from Dow Corning Corporation, this problem is alleviated.

An additional problem associated with fabrics which are post-coated is the flattening of the strands during drying and winding. This problem has been solved in the warp (machine) direction using a chain stitch in the knitting process, which serves to bundle the warp yarn in a circle. This particular effect is augmented when the fabric is heated, and the stitching yarn shrinks and tightens about the fiberglass warp yarn. Through the use of highly twisted yarns in the weft (e.g., from about 1.0–2.5 turns per inch), the flatness is minimized, even without the benefit of cross-machine tension to amplify the effect of twist.

While the invention has been described in detail and with reference to specific examples thereof, it will be apparent to one skilled in the art that various changes and modifications can be made therein without departing from the spirit and scope thereof.

What is claimed is:

1. A method for manufacturing a knitted screen cloth fabric, including a polymer coated, fiber-reinforced, flexible, foil-like web, which comprises applying a polymer coating during a dip-coating process following the knitting process, wherein the fabric is coated after its formation.

2. The method as recited in claim 1, wherein the polymer coating is applied in-line with the knitting process.

3. The method as recited in claim 1, wherein the coated fabric further comprises from about 0.1–0.5% of a defoamer.

4. The method as recited in claim 1, wherein the weight of the coating comprises about 15–80 weight % of total, coated fabric.

* * * * *